US006430972B1

(12) United States Patent
Motzke

(10) Patent No.: US 6,430,972 B1
(45) Date of Patent: Aug. 13, 2002

(54) DEVICE FOR REMOISTENING A DRIED PAPER WEB

(75) Inventor: Michael Motzke, Augsburg (DE)

(73) Assignee: Baldwin Grafotec GmbH, Augsburg (DE)

( * ) Notice: Subject to any disclaimer, the term of this patent is extended or adjusted under 35 U.S.C. 154(b) by 0 days.

(21) Appl. No.: 09/467,918

(22) Filed: Dec. 21, 1999

(30) Foreign Application Priority Data

Jan. 19, 1999 (DE) ..... 199 01 802

(51) Int. Cl.[7] ..... D06B 1/02
(52) U.S. Cl. ..... 68/205 R; 134/64 R; 134/122 R
(58) Field of Search ..... 68/205 R; 134/122 R, 134/64 R; 15/320, 321

(56) References Cited

U.S. PATENT DOCUMENTS 3,574,261 A * 4/1971 Bailey
3,762,187 A * 10/1973 Fleissner et al.
4,430,779 A * 2/1984 Rockman et al.
4,711,431 A * 12/1987 Viannay et al.
4,805,425 A * 2/1989 Fleissner
5,384,968 A * 1/1995 Grandjean
5,548,905 A * 8/1996 Kuma et al.
5,642,671 A * 7/1997 Winheim
5,783,044 A * 7/1998 Schneider et al.
5,799,409 A * 9/1998 Chau-Huu et al.
5,813,332 A * 9/1998 Langer et al.
5,845,415 A * 12/1998 Sund
5,849,321 A * 12/1998 Linnonmaa
5,964,956 A * 10/1999 Straub et al.
5,964,960 A * 10/1999 Boeck
6,063,449 A * 5/2000 Koskinen et al.
6,148,831 A * 11/2000 Lindstrom et al.
6,203,858 B1 * 3/2001 Plomer
6,248,407 B1 * 6/2001 Hees

FOREIGN PATENT DOCUMENTS

DE 195 39 015 * 10/1996
GB 2282463 * 4/1994

* cited by examiner

*Primary Examiner*—Frankie L. Stinson
(74) *Attorney, Agent, or Firm*—Jones, Tullar & Cooper, P.C.

(57) ABSTRACT

In a device for remoistening a preferably freshly printed paper web with spray jets, through which moisturising agents can be admitted, arrayed above and below the said paper web, and spray chambers containing the same, a reliable ventilation can be achieved in the spray chambers, in that each spray chamber is arrayed in a dedicated suction chamber, which can be sucked out by means of at least one dedicated extraction fan.

9 Claims, 1 Drawing Sheet

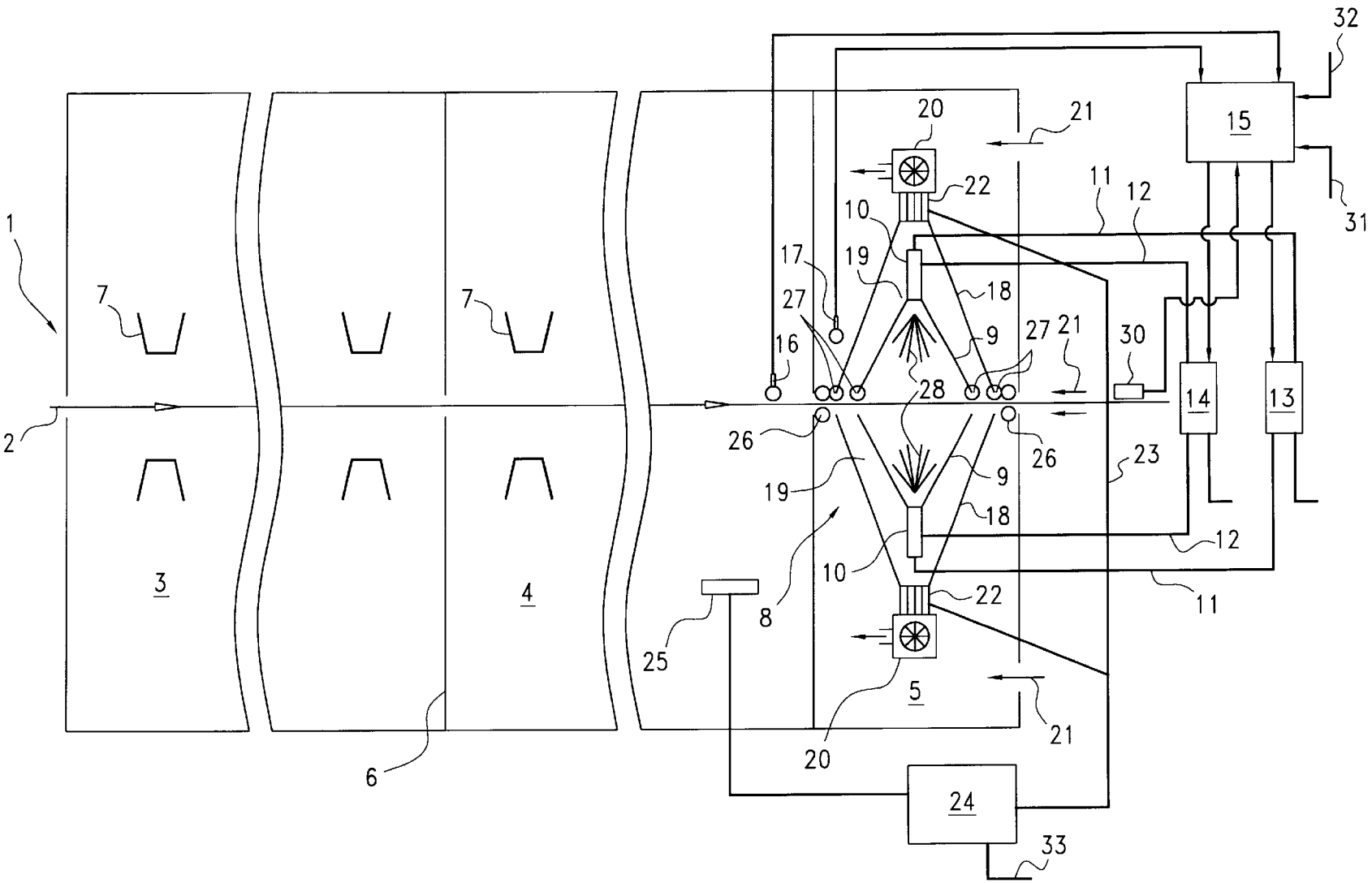
32
31
15
13
14
12
11
30
23
21
27
26
18
9
22
20
28
10
19
17
16
8
5
24
33
25
4
3
7
6
1
2

DEVICE FOR REMOISTENING A DRIED PAPER WEB

FIELD OF THE INVENTION

The invention concerns a device for remoistening a preferably freshly printed, dried paper web by means of spray jets, through which moisturizing agents can be admitted, arrayed above and below the paper web, and spray chambers containing the same.

BACKGROUND OF THE INVENTION

A device of this kind is known from U.S. Pat. No. 5,813,332 (DE 196 15 198 C1). In this known array, each of the spray chambers is followed immediately downstream by a jet-free condensation chamber, which is equipped with an exhaust air shaft. The flow resistance in this exhaust air shaft is relatively high. On the other hand, the volume of air channelled into the spray chambers is very large. For every liter of moisturizing agent, approximately one cubic meter of compressed air is normally channelled to the spray jets and thus to the spray chambers. There is therefore a danger that the entire volume of air will not be siphoned off through the exhaust air shaft, which exhibits a comparatively high flow resistance, so that there is a risk that part of the air will overcome the air squeegees provided in the area of the inlet or outlet slits of the known array and will not make its way outside. This may lead to the moisturizing agent forming condensation on the outer side of the housing. There is therefore the danger that drops of condensation falling downwards will dirty the paper web. A further disadvantage of the known array can be identified in the fact that the condensation of a remoistening apparatus situated downstream of the chilling roller stand may also make its way to or be formed on the chilling rollers, especially the first chilling roller, which leads to an undesirable swimming effect of the paper web.

SUMMARY OF THE INVENTION

Starting from this, it is therefore the task of the present invention to improve a device of the kind mentioned above with simple, cheap means, so that the air channelled to the spray chambers can be relied on to be siphoned off.

According to the invention, this task is achieved in that each spray chamber is arrayed in a dedicated suction chamber, which can be sucked out by means of at least one dedicated extraction fan each.

With these measures, the disadvantages described above of the generic state of the art can be avoided completely. The measures according to the invention guarantee that the air channelled into the spray chambers is captured in the relative dedicated suction chamber and can be relied on to be siphoned off by means of the extraction fan. It is advantageous in this case that there is no danger of any air penetrating outwards, of the related formation of condensation and dirtying of the paper web as a result of falling drops of condensation, nor of the swimming effect of the paper web on the chilling rollers. The advantages that can be achieved with the measures according to the invention are therefore particularly evident in terms of avoiding operational breakdowns and staining and thus of a higher economic yield.

Advantageous embodiments and functional further developments on the above-listed measures are described in the sub-claims. In this way, at least one cooler can be situated upstream of each extraction fan. This cooler functions practically as a condenser, for the purpose of separating out liquids in the form of moisture and oil, which can then be disposed of as the law requires. In this way, the printing room is guaranteed not to be subjected to undesirable oil vapour deposits.

For this purpose, each cooler can be functionally connected to an oil vaporiser arrayed with a dryer provided for the purpose of drying the freshly printed paper web, via a condensation conduit leading preferably through a water separator, so that there is no longer any need to undertake costly disposal of the oil as special refuse.

One further advantageous measure may consist of the fact that the spray and suction chambers can be arrayed in the cooling zone of a dryer provided for the purpose of drying the freshly printed paper web. In this way, the necessary distance between the dryer and a chilling roller stand situated downstream of it is reduced. In addition, this enables the extraction fans simply to blow out into the dryer, which does away with the need for separate exhaust systems and at the same time improves the energy balance of the dryer, as the air blown out by the extraction fans is already preheated. A further advantage of these measures can be identified in that not only can the moisture content of the paper web be increased to the desired level in this way, but the paper web can also be subjected to a liquid cooling, which has an advantageous effect in terms of construction volume savings. At the same time, this ensures that the spray streams striking the paper web can be relied on to break down the laminate air layer flanking the paper web, which is laden with solvents, as a consequence of its high penetration force and because of the marked increase in volume ensuing from vaporisation, so that the solvent conveyed together with the air can be relied upon to be sucked out by means of the suction device together with the air siphoned off and cannot penetrate outside.

Additional advantageous embodiments and functional further developments on the above-listed measures are described in the other sub-claims and can be deduced in greater detail from the following description of examples, with the aid of the drawing.

BRIEF DESCRIPTION OF THE DRAWING

The drawing described hereunder illustrates a schematic longitudinal cross-section through a dryer equipped with a moisturising device.

DESCRIPTION OF THE PREFERRED EMBODIMENTS

The field in which the invention is applied is generally that of web-fed rotary printing presses with a dryer arrayed in a position immediately downstream. The basic construction and the method of functioning of such arrays are already known. The following description is therefore restricted substantially to the area of the dryer affected by invention.

The dryer 1 illustrated in the drawing, which is arrayed between a web-fed rotary printing process not illustrated here in any detail and a chilling roller stand, also not illustrated here in any detail, has three zones arrayed one after the other in the direction in which the paper web 2 moves, namely a heating zone 3, a temperature maintenance zone 4 and a cooling zone 5. A section inside the housing of the dryer 1 is devoted to each zone. Partition bulkheads 6 are provided between the contiguous sections.

In the heating zone 3 and the temperature maintenance zone 4, the paper web is sprayed with hot air, as indicated through jets 7. The section devoted to the cooling zone contains a moisturising device indicated in its entirety with the number 8, whose purpose is to cool and remoisten the paper web 2, which loses moisture in the preceding zones because of the heat treatment situated there.

A moisturising agent, preferably in the form of water, is admitted to the paper web 2 with the aid of the moisturising device 8. The amount of moisturising agent applied to the paper web 2 during this process is great enough to cool the paper web 2 down to the desired temperature and at the same time to increase the moisture content of the paper web 2 to the desired level. The cooling is brought about by vaporising liquid, while the vaporisation heat is withdrawn from the paper web 2. However, the vaporising liquid does not produce any remoisturising. The total quantity of the liquid channelled to the paper web 2 thus consists of a remoisturising share and an additional amount for cooling purposes.

The total amount of liquid is adjusted correspondingly as a function of the need of the paper web 2 for moisture and of the desired difference in cooling temperature. In simple cases, provision can be made for a control system that depends on the temperature of the paper web 2 before the moisturising device 8, i.e. practically at the exit of the temperature maintenance zone 4, as well as on the velocity of the web and the type of paper. Another form of control is also feasible, however, in which, in addition or as an alternative, the moisture and/or the temperature of the paper web 2 after the moisturising device 8 and/or the temperature in the cooling zone 5 are fed in as nominal values.

The moisturising device 8 is equipped with roof- or v-shaped spray chambers 9 above and below the transport surface of the paper web 2, each of which contains a row of spray jets 10 covering the entire width of the said paper web 2. Provision could of course be made for several rows of jets. The row of spray jets stretches practically across the entire width of the dryer and can be adjusted to the width of the paper web by switching off the outer jets.

In the example illustrated, a moisturising agent, preferably in the form of water, and compressed air are admitted through the spray jets 10, for the purpose of blowing the moisturising agent out and dedusting it, as indicated by the supply conduits 11, 12. These are fitted with switching mechanisms in the shape of valves etc., which in this case can be regulated by means of an adjustment device 15, which exhibits the nominal value inputs for the temperature of the paper web 2 before moisturising, the temperature of the cooling zone 5 and the moisture and temperature of the paper web 2 after moisturising. These nominal value inputs are connected via signalling lines to dedicated sensors, here the temperature probes 16, 17 and a combined temperature and moisture probe 30.

The temperature probe 16 dedicated to the web temperature before moisturising is arrayed in the exit area of the temperature maintenance zone 4, in the vicinity of the paper web 2. The temperature probe 17 dedicated to the temperature in the cooling zone 5 is arrayed in the cooling zone 5, outside the moisturising device 8. The combined temperature and moisture probe 30 is arrayed in the area of the exit of the dryer 1. In addition, the control device 15 is also equipped with a further entrance 31 for the web velocity, preferably coupled with the printing press, and with an input station 32 for inputting fixed parameters, such as the type of paper.

Each of the spray chambers 9 is overlapped above or below by a dedicated roof- or v-shaped suction chamber 18, in such a way that extraction shafts 19 result on the entry and the exit sides. These are sucked out individually or together. For this purpose, in the example illustrated, an extraction fan 20 is provided, arrayed in the area of the corner of each suction chamber 18 situated furthest away from the paper web, whose function is to suck out the dedicated suction chamber 18 in question and blow into the section of the dryer 1 dedicated to the cooling zone 5. In this way, tempered air is channelled to the dryer 1, so that the amount of fresh air sucked in from outside and indicated with arrow 21 can be reduced accordingly, which has a positive effect on overall energy consumption.

A cooler 22 is arrayed upstream of each extraction fan 20. This cooler functions practically as a condenser for separating out liquids in the form of moisture and oil from the extracted air. Relatively unloaded air is thence channelled through the extraction fan 20 to the dryer 1. The condensation separated out by means of the cooler 22 is siphoned off by means of a condensation drainage conduit 23. This leads via a water separator 24, where water is separated out, to an oil vaporiser 25 situated preferably in the dryer 1, but illustrated here in the temperature maintenance zone 4, where oil is evaporated, so that it can be disposed of by means of the dryer's own post-combustion plants. In order to avoid the need for disposal, the separated water can be channelled back to the jets 10. For this purpose, the water outlet 33 of the water separator 24 can be conducted back into the supply conduit 11. The inlet is situated suitably upstream from the switching mechanism 13.

Air squeegees 26 through which compressed air can be admitted can be provided at the entrance and the exit of the suction chambers 18, with the function of avoiding any air loaded with moisture escaping from the suction chambers 18. This guarantees that no condensation can collect outside the moisturising device 8 inside and outside the dryer, which might otherwise drip onto the paper web 2 and dirty it. Condensation collects on the internal sides of the spray chambers 9 and the suction chambers 18 and then drains off downwards. In the lower chambers, this condensation drains into the cooler 22 and is channelled away through the drainage conduits that are certainly already provided there. In order to avoid condensation dripping from the lower edges of the bulkheads, the upper spray chamber 9 and the suction chamber 18 are equipped with drop catchers 27, which can be affixed functionally to the condensation drainage conduit 23 in a way not illustrated here in any detail.

The consequence of the liquid cooling of the paper web 2 that can be achieved by integrating the moisturising device 8 in the cooling zone 5, as can be seen clearly from the drawing, is a construction of the cooling zone 5 that is very compact compared to the zones 3 and 4. The liquid streams 28 that can be generated by means of the spray jets 10 have a high penetrating force, whereby the laminate air layers flanking the paper web 2, which are loaded with solvents, can be relied on to be broken down. This is also supported by the increase in volume resulting from the vaporisation. The solvent is sucked out together with the air and can be relied on to be disposed of together with it.

What is claimed is:

1. A device for remoistening a preferably freshly printed, dried paper web with spray jets, through which moisturising agents can be admitted, arrayed above and below the said paper web, and spray chambers containing the same, whereby: each spray chamber is arrayed in a dedicated suction chamber, which can be sucked out by means of at least one extraction fan; at least one cooler is arrayed upstream of each extraction fan; each cooler is connected via a condensation drainage conduit to an oil vaporiser arrayed in a dryer provided for the purpose of drying the paper web, preferably in the area of a temperature maintenance zone of the said dryer; at least one water separator is arrayed downstream of each cooler; and the water separator is arranged in the condensation drainage conduit.

2. The device according to claim 1, whereby a moisturising agent and compressed air can be admitted through the spray jets for the purpose of blowing out the moisturising agent.

3. A device according to claim 1, whereby said suction chamber includes an entrance and an exit and whereby air squeezes through which compressed air can be admitted are provided at the entrance and the exit of said suction chamber.

4. A device according to claim 1, whereby the upper spray chamber and the suction chamber include a bulkhead defining a lower end, and whereby drop catchers are situated at the lower ends of the bulkheads of the upper spray chamber and suction chamber.

5. A device according to claim 1, whereby the spray chambers and the suction chambers have a roof- or v-shaped form.

6. A device according to claim 1, whereby the extraction fan blows into said dryer.

7. A device according to claim 1, whereby the paper web is imprinted by means of an oil-containing ink.

8. A device for remoistening a preferably freshly printed, dried paper web with spray jets, through which moisturising agents can be admitted, arrayed above and below the said paper web, and spray chambers containing the same, whereby each spray chamber is arrayed in a dedicated suction chamber, which can be sucked out by means of at least one extraction fan, and whereby the spray chambers, each complete with its respective dedicated suction chamber, are arrayed in a cooling zone of a dryer provided for the purpose of drying the upper paper web, whereby the amount of moisturising agent channeled to the spray jets is greater than the amount of remoistening, while the amount of moisturising agent channeled to the spray jets can be adjusted by means of an adjustment device, preferably as a function of the type of paper, of the velocity of the paper web, of the temperature of the paper web upstream of the moisturising device and/or of the temperature in said cooling zone of the dryer and/or of the temperature of the paper web downstream of the moisturising device and/or of the humidity of the paper web downstream of the moisturising device.

9. A device according to claim 8, whereby the paper web is imprinted by means of an oil-containing ink.

* * * * *